United States Patent [19]

Perrotti

[11] 4,266,228

[45] May 5, 1981

[54] CIRCULARLY POLARIZED CROSSED SLOT WAVEGUIDE ANTENNA ARRAY

[75] Inventor: Emmanuel J. Perrotti, Ramsey, N.J.

[73] Assignee: International Telephone and Telegraph Corporation, New York, N.Y.

[21] Appl. No.: 11,268

[22] Filed: Feb. 12, 1979

Related U.S. Application Data

[63] Continuation of Ser. No. 832,149, Sep. 12, 1977, abandoned.

[51] Int. Cl.[3] ..... H01Q 13/10

[52] U.S. Cl. ..... 343/771; 343/767

[58] Field of Search ..... 343/771, 770, 768, 767

[56] References Cited

U.S. PATENT DOCUMENTS

| | | | |
|---|---|---|---|
| 2,981,948 | 4/1961 | Kurtz | 343/771 |
| 3,281,851 | 10/1966 | Goebels, Jr. | 343/771 |
| 3,701,162 | 10/1972 | Seaton | 343/771 |
| 3,720,953 | 3/1973 | Ajioka | 343/771 |

*Primary Examiner*—David K. Moore

*Attorney, Agent, or Firm*—John T. O'Halloran; Alfred C. Hill

[57] ABSTRACT

The array includes at least a first pair of waveguides disposed side by side and a first plurality of crossed slots disposed in each of the first pair of waveguides with the slots of one of the first pair of waveguides being axially displaced from the slots in the other of the first pair of waveguides one half of the waveguide wavelength. For transmission, both extremities of one of the pair of waveguides are excited out of phase with respect to both extremities of the other of the pair of waveguides to produce in-phase excitation of the slots. To receive, a waveguide is disposed in the central area of each of the first pair of waveguides. The array may be enlarged by placing additional identical pairs of waveguides disposed side by side with respect to each other and the first pair of waveguides. The additional pairs of waveguides contain additional slots identical to the first plurality of slots.

5 Claims, 3 Drawing Figures

CIRCULARLY POLARIZED CROSSED SLOT WAVEGUIDE ANTENNA ARRAY

CROSS-REFERENCE TO RELATED APPLICATIONS

This is a continuation Application of application Ser. No. 832,149, filed Sept. 12, 1977 (now abandoned).

BACKGROUND OF THE INVENTION

This invention relates to circularly polarized antennas and more particularly to a circularly polarized crossed slot waveguide antenna array.

SUMMARY OF THE INVENTION

An object of the present invention is to provide an improved circularly polarized crossed slot waveguide antenna array.

A feature of the present invention is the provision of a circularly polarized crossed slot waveguide antenna array comprising: at least a first pair of waveguides disposed side by side, each of the first pair of waveguides having a longitudinal axis parallel to each other; and a first plurality of crossed slots disposed in each of the pair of waveguides with the slots of one of the first pair of waveguides being axially displaced from the slots in the other of the first pair of waveguides a predetermined amount.

BRIEF DESCRIPTION OF THE DRAWING

Above-mentioned and other features and objects of this invention will become more apparent by reference to the following description taken in conjunction with the accompanying drawing, in which.

DESCRIPTION OF THE PREFERRED EMBODIMENT

Before describing the circuit of the present invention, it is necessary to describe the action of the waveguide aperture.

Figure 1:
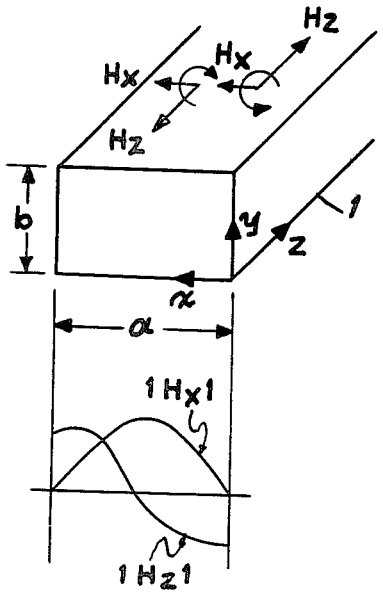
FIG. 1 is a schematic diagram illustrating the waveguide field configuration for a $TE_{10}$ mode waveguide.

The requirement for circular polarization uniquely dictates the position and general shape of the slots of a waveguide array. FIG. 1 illustrates the longitudinal and transverse magnetic fields of a $TE_{10}$ mode rectangular waveguide 1. The magnetic field components are in time quadrature, and are equal in magnitude at the points given by $$x = \frac{a}{\pi} \operatorname{cotan}^{-1} \{\pm [(\frac{2a}{\lambda})^2 - 1]\}$$

where a equals the width of waveguide 1, λ equals the freespace wavelength and x equals the transverse coordinate. The currents in the boardwalls at the points determined by the above equation are circularly polarized. As a result, placing crossed slots with their centers at the prescribed location will result in interruptions of the circularly polarized currents thus producing circularly polarized radiation. The sense of the circular polarization will depend on which side of the waveguide centerline or longitudinal axis the crossed slots are placed. In addition, the direction of the exciting wave in the waveguide will determine the sense of polarization for any given slot. The sense of polarization can be changed by changing the direction of propagation in waveguide 1. The radiation properties of the slot are controlled by the slot width and length. It has been determined that the same radiation characteristic, the maximum radiation obtainable from a given slot is approximately 70 to 75% of the available power. It has also been determined that the resonant frequency is increased by decreasing the length of the slot for a constant width. Measurements have also verified that the impedance match of the slot of the waveguide is extremely good over the frequency band of interest. This is enhanced since the small amount of energy reflected from the slot travels in the direction of the original wave and is either radiated by succeeding slots, or is absorbed in the termination of the waveguide.

A survey of the literature concerning slot radiators indicates that characterizing crossed slots in terms of their true circuit parameters has not been done since the slot is neither a series nor shunt circuit. To circumvent these difficulties, measurements were taken by treating a waveguide containing a crossed slot as a lossy transmission line. By measuring inspection loss of the waveguide with a single crossed slot versus a waveguide without the slot, the power radiated by the slot as well as the power transmitted to the waveguide termination were ascertained. It also was found that there was little change in phase as a result of introducing the radiating slot into the waveguide. This fact is substantiated in an article by A. J. Simmons, "Circularly Polarized Slot Radiators", IRE Transactions on Antennas and Propagation, January, 1957, Pages 31–36. The radiation axial ratio of a slot can be determined by examining the components of the surface current density for the $TE_{10}$ mode.

$$K_x = \pm jK_o(\frac{\lambda}{2a}) \cos \frac{\pi x}{a} f(z)$$

$$K_z = \pm K_o \sqrt{1 - (\frac{\lambda}{2a})^2} \sin \frac{x}{a} f(z)$$

where $K_z$ and $K_x$ are the components of current density.

The Z-dependence of the currents are given by the function f(z) which indicated the Z variations and current along the longitudinal waveguide dimension.

The slot radiator may be analyzed, applying Babinet's principle, as that of a dipole radiator driven by electric currents given approximately by the unperturbed surface currents on the waveguide wall in the vicinity of the slot with the slot absent.

Figure 2:
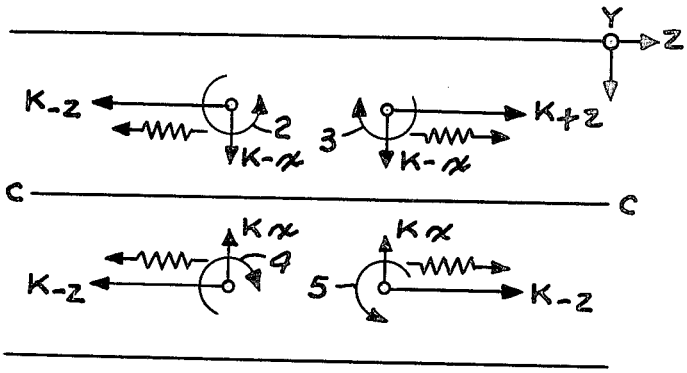
FIG. 2 is a schematic illustration of the currents in a $TE_{10}$ waveguide mode for opposite directions of propagation.

For a dipole radiator, the far fields are proportional to the excitation current density. The currents are shown in FIG. 2 for waves propagated in the ±Z-direction and for positions on both sides of the waveguide center line C—C. The circular arrows 2, 3, 4 and 5 indicate the direction of rotation of the elliptical polarization. It is seen that the radiation is generally elliptically polarized and the sense of polarization depends on two factors; (1) the direction of propagation in the waveguide, and (2) the location of the slot with respect to the center line or longitudinal axis of the waveguide.

$$\text{NOTE: } \frac{2a}{\lambda g} = \sqrt{\left(\frac{2a}{\lambda}\right)^2 - 1} = Ra$$

where: Ra is the axial ratio for the case where slots are positioned midway between the waveguide centerline and the waveguide sidewall.

Figure 3:
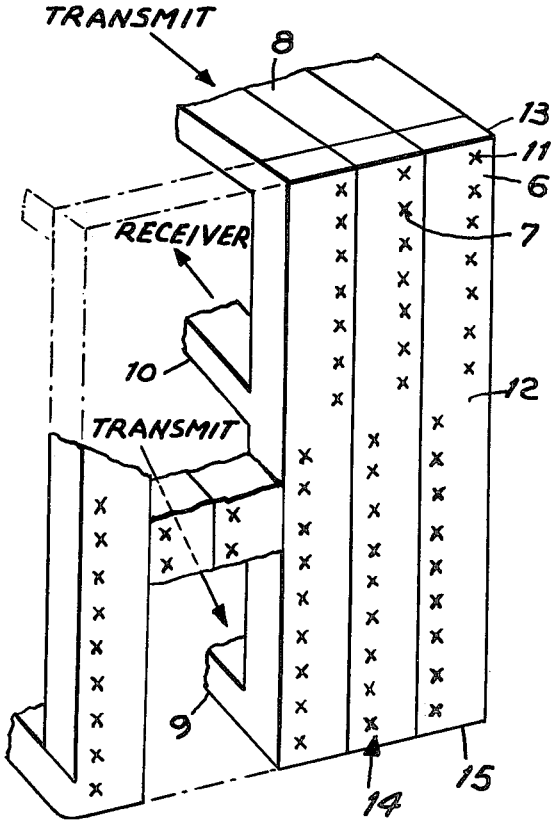
FIG. 3 is an isometric view of a circularly polarized crossed slot waveguide array in accordance with the principles of the present invention.

To excite a line array of crossed slots in-phase, they must be one waveguide wavelength apart. Since this space is larger than the freespace wavelength, grating lobes will result. A solution to this problem is to position two waveguides side by side with the slots in one axially displaced from those in the other by $\lambda g/\sqrt{2}$. This is shown in FIG. 3 by the crossed slot waveguide array including waveguides 6 and 7. Crossed slots 11 are disposed on one side of the longitudinal axis of waveguide 6 extending from the center area 12 to an extremity 13 of waveguide 6 and crossed slots 14 are disposed on the other side of the longitudinal axis of waveguide 6 extending from the center area 12 to an extremity 15 of waveguide 6. All other waveguides in the array have the same slot orientation to enable transmission and reception of circularly polarized waves. The two waveguides 6 and 7 thus form a planar array with the maximum spacing between elements occurring in the intercardinal plane. The value of this spacing is $\lambda g/\sqrt{2}$. Grating lobes in any plane can thus be avoided if the bandwidth is so chosen that the freespace wavelength is not less than $\lambda g/\sqrt{2}$. The two waveguides 6 and 7 are excited out of phase to produce in-phase excitation of all slots.

A number of waveguide pairs, such as waveguides 6 and 7, can be joined into one aperture to form a circularly polarized, crossed slot array. An array or aperture which would afford opposite hand polarization for transmit and receive functions is shown in FIG. 3. The array of FIG. 3 is free from frequency steering because it is symmetrically fed from both ends 8 and 9 for transmit and from the middle 10 for receive.

While I have described above the principles of my invention in connection with specific apparatus it is to be clearly understood that this description is made only by way of example and not as a limitation to the scope of my invention as set forth in the objects thereof and in the accompanying claims.

I claim:

1. A circularly polarized crossed slot waveguide antenna array comprising:

at least a first pair of waveguides supporting only the $TE_{10}$ mode disposed side by side, each of said first pair of waveguides having a first broad wall facing in the same direction, each of said first broad walls having a longitudinal center line; and a first plurality of crossed slots disposed in each of said first broad walls parallel to and spaced from said center line, each of one half of said first plurality of crossed slots on one side of a central area of each of said first broad walls between both extremities of each of said first pair of waveguides being disposed on one side of said center line and each of the other half of said first plurality of crossed slots on the other side of said central area being disposed on the other side of said center line, said first plurality of crossed slots in one of said first broad walls being spaced from said first plurality of crossed slots in the other of said first broad walls a predetermined amount;

said first pair of waveguides and each of said first plurality of crossed slots cooperating to provide a single beam, circularly polarized antenna pattern for said array; each of said first pair of waveguides are excited at both extremities thereof for transmission of circularly polarized radiation, both extremities of one of said first pair of waveguides being excited out of phase with both extremities of the other of said first pair of waveguides to produce in-phase excitation of said first plurality of crossed slots; and a second pair of waveguides each disposed orthogonally to a second broad wall of a different one of said first pair of waveguides, each of said second broad walls being parallel to an associated one of said first broad walls, each of said second pair of waveguides intersecting an associated one of said second broad walls in a central area thereof intermediate said both extremities to receive circularly polarized radiation received by said array.

2. An antenna array according to claim 1, wherein said predetermining amount is one half of the waveguide wavelength.

3. An antenna array according to claim 2, further including additional pairs of waveguides disposed side by side with each other and said first pair of waveguides, said additional pairs of waveguides being identical to said first pair of waveguides, and additional pluralities of crossed slots disposed in each of said additional pairs of waveguides identical to said first plurality of slots.

4. An antenna array according to claim 1, further including additional pairs of waveguides disposed side by side with each other and said first pair of waveguides, said additional pairs of waveguides being identical to said first pair of waveguides, and additional pluralities of crossed slots disposed in each of said additional pairs of waveguides identical to said first plurality of slots.

5. A circularly polarized crossed slot waveguide antenna array comprising:

at least a first pair of waveguides disposed side by side each having a first broad wall facing in the same direction, each of said first broad walls having a longitudinal center line;

a plurality of crossed slots disposed in each of said first broad walls parallel to and spaced from said center line, each of one half of said plurality of crossed slots on one side of a central area of each of said first broad walls between both extremities of each of said pair of waveguides being disposed on one side of said center line and each of the other half of said plurality of crossed slots on the other side of said central area being disposed on the other side of said center line, said slots in one of said first broad walls being spaced from said slots in the other of said first broad walls a predetermined amount;

said first pair of waveguides and each of said plurality of crossed slots cooperating to provide a single beam, circularly polarized antenna pattern for said array; each of said first pair of waveguides are excited at both extremities thereof for transmission of circularly polarized radiation, both extremities of one of said first pair of waveguides being excited out of phase with both extremities of the other of said first pair of waveguides to produce in-phase excitation of said first plurality of crossed slots and a second pair of waveguides each disposed orthogonally to a second broad wall of a different one of said first pair of waveguides, each of said second broad walls being parallel to an associated one of said first broad walls, each of said second pair of waveguides intersecting an associated one of said second broad walls in a central area thereof intermediate said both extremities of said first pair of waveguides to only receive circularly polarized radiation received by said array.

* * * * *